United States Patent [19]

Baldwin et al.

[11] 4,189,372

[45] Feb. 19, 1980

[54] PROCESS FOR THE HYDROCONVERSION OF COAL

[75] Inventors: Roger A. Baldwin, Warr Acres; Robert E. Davis; Raymond C. Janka, both of Oklahoma City, all of Okla.

[73] Assignee: Kerr-McGee Corporation, Oklahoma City, Okla.

[21] Appl. No.: 907,933

[22] Filed: May 22, 1978

[51] Int. Cl.[2] ..... C10G 1/00; C10G 1/06

[52] U.S. Cl. ..... 208/8 LE; 208/10; 208/177

[58] Field of Search ..... 208/8 LE, 10

[56] References Cited

U.S. PATENT DOCUMENTS

| | | | |
|---|---|---|---|
| 3,598,718 | 8/1971 | Gleim et al. | 208/8 LE |
| 3,607,716 | 9/1971 | Roach | 208/8 |
| 3,607,717 | 9/1971 | Roach | 208/8 |
| 3,607,718 | 9/1971 | Leaders et al. | 208/10 |
| 3,700,583 | 10/1972 | Salamony et al. | 208/8 |
| 3,852,182 | 12/1974 | Sze et al. | 208/10 X |
| 3,932,266 | 1/1976 | Sze et al. | 208/10 |
| 3,974,073 | 8/1976 | Sze et al. | 208/8 LE |
| 3,997,425 | 12/1976 | Gatsis et al. | 208/8 |

*Primary Examiner*—Delbert E. Gantz
*Assistant Examiner*—William G. Wright
*Attorney, Agent, or Firm*—William G. Addison

[57] ABSTRACT

This invention relates to a process for producing coal derived, hydrogen-rich donor fractions from fractions of coal liquefaction products for use in the hydroconversion of coal. Coal liquefaction products are subjected to a critical solvent deashing process to produce various deashed coal fractions which can only be obtained by practicing that process. Thereafter, the various deashed coal fractions are subjected to hydrogen addition to produce heretofore unavailable hydrogen-rich donor fractions. These hydrogen-rich donor fractions may be recycled to supplant a portion of the liquefaction process solvent or blended with other fractions produced by the deashing process to provide improved fuel products.

10 Claims, 2 Drawing Figures

PROCESS FOR THE HYDROCONVERSION OF COAL

BACKGROUND OF THE INVENTION

1. Field of the Invention

This invention relates to a process for treating fractions of coal liquefaction products to produce coal derived, hydrogen-rich donor fractions suitable for use as coal liquefaction process solvents.

2. Description of the Prior Art

It is known to convert raw coal to coal liquefaction products through the use of hydrogen donor solvents. It would be desirable economically to provide a process for treating selected fractions of such products whereby they would be suitable for use as hydrogen-containing coal liquefaction solvents.

In some processes, such as U.S. Pat. Nos. 3,607,718; 3,700,583; and 3,997,425, it has been suggested that various distillate fractions can be hydrotreated in order to generate the necessary hydrogen donor solvent for recycle to the coal liquefaction zone.

In other coal liquefaction processes, such as those described in U.S. Pat. Nos. 3,607,716 and 3,607,717, the recovery of theretofore unavailable fractions of coal liquefaction products has been described. The hydrotreating of these recovered fractions, obtained via the use of deashing solvents near their critical temperature, has also been described. However, the resulting hydrotreated fractions have been described only as having use as fuels.

SUMMARY OF THE INVENTION

The present invention provides a procedure for producing heretofore unavailable coal derived, hydrogen-rich donor fractions from fractions of coal liquefaction products. The hydrogen-rich donor fractions may be used in the subsequent hydroconversion of additional carbonaceous materials to provide a more economical yield of deashed coal products and to produce low sulfur content blends of deashed coal products.

In practice, particulate coal is contacted with a process solvent in a coal liquefaction zone maintained at elevated temperature and pressure to effect at least a partial conversion of the coal to form coal liquefaction products. The coal liquefaction products and process solvent then may be introduced into a fractionation zone. In the fractionation zone, coal distillate fractions and process solvent are separated and recovered. Thereafter, at least a portion of the coal liquefaction products residuum comprising substantially non-distillable soluble coal products and insoluble coal products are subjected to a deashing operation employing deashing solvent maintained near the critical temperature of the deashing solvent. Alternatively, the coal liquefaction products may be introduced directly into the deashing apparatus.

The deashing operation first separates the insoluble coal products from most of the soluble coal products and most of the deashing solvent. Then, the soluble coal products are separated into one or more deashed coal fractions. The heavier deashed coal fractions are recovered and can be used as a solid fuel material or blended with other coal liquefaction products. The lighter deashed coal fractions are recovered and passed to a hydrogen addition zone wherein the fractions are treated to yield heretofore unavailable hydrogen-rich donor fractions.

It now has been discovered that these heretofore unavailable hydrogen-rich donor fractions can be recycled to the coal liquefaction zone to supplant a portion of the process solvent, in the conversion of the particulate coal to form coal liquefaction products.

DESCRIPTION OF THE PREFERRED EMBODIMENT

Figure 1:
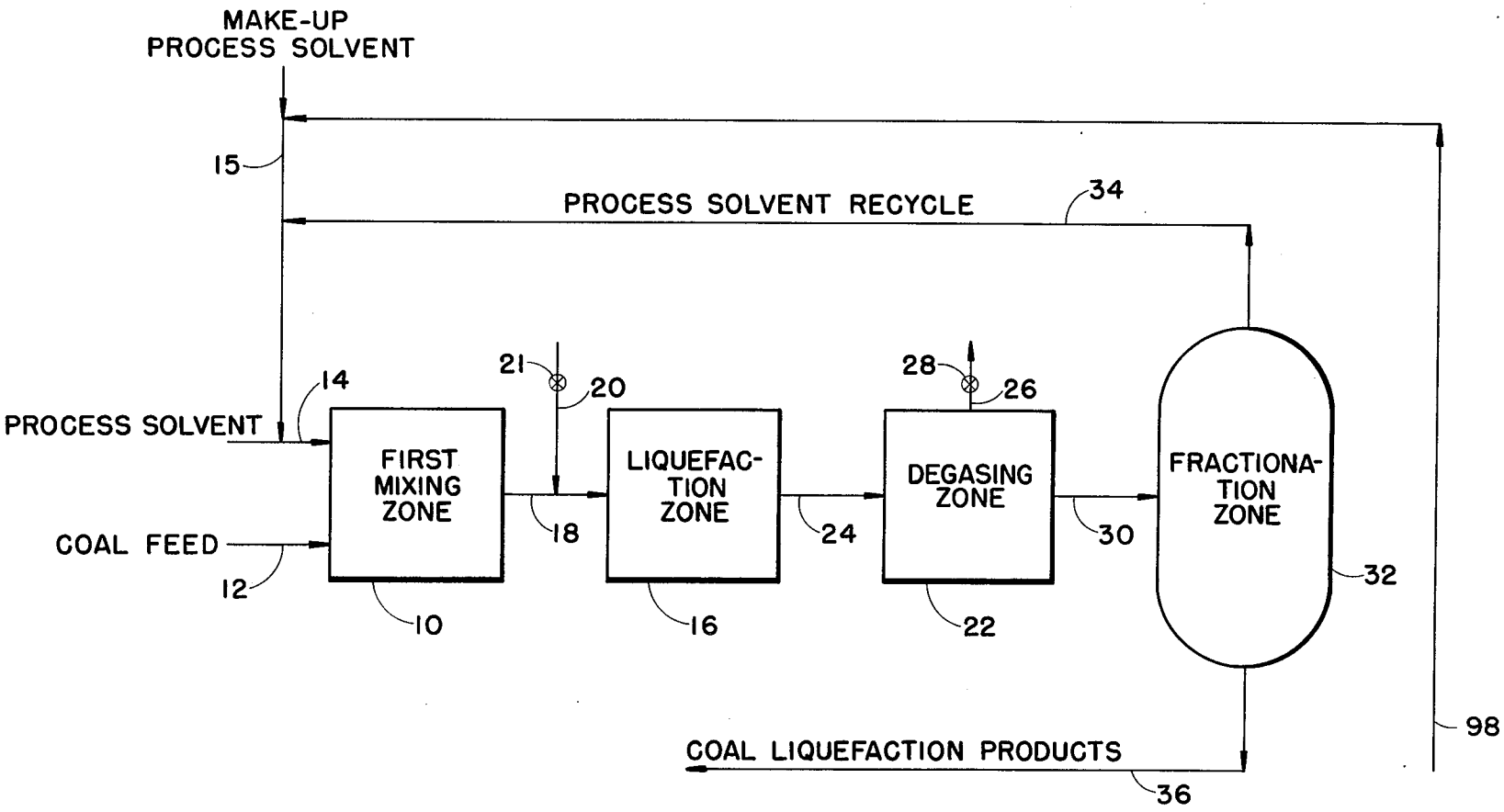
FIG. 1 is a diagrammatic, schematic illustration of a coal liquefaction process.

Turning now to FIG. 1, a coal feed to be processed in accordance with this invention is contacted with a process solvent in a first mixing zone 10. The term "coal feed" as used herein refers to pulverized raw coal, mineral matter containing hydrocarbonaceous fractions obtained in the conversion of raw coal or the like. The coal feed is passed to the first mixing zone 10 via a conduit 12. Process solvent enters the first mixing zone 10 via a conduit 14 from a source not shown.

In the first mixing zone 10, the coal feed and process solvent are agitated with a stirring mechanism at about ambient temperature and pressure to form a slurry. The slurry then is withdrawn and introduced into a liquefaction zone 16 via a conduit 18.

In the liquefaction zone 16, the feed undergoes conversion to form coal liquefaction products comprising soluble coal products and insoluble coal products in admixture with the process solvent.

In one embodiment, hydrogen gas, synthesis gas mixtures or mixtures of water and carbon monoxide can be introduced into the slurry flowing in conduit 18 through a conduit 20 and a valve 21 interposed therein, from a source not shown. The presence of this additional hydrogen aids in the conversion of the feed to provide a higher yield of coal liquefaction products.

The mixture of soluble coal products, insoluble coal products, process solvent and gases, if any, is withdrawn from the liquefaction zone 16 and passed to a degassing zone 22 via a conduit 24 wherein the mixture is degassed by permitting excess hydrogen, and any other gases or vapors to be discharged from the degassing zone 22 through a conduit 26, a pressure reducing valve 28 being interposed therein. Such gases may be recycled, after suitable purification, if desired, to the liquefaction zone 16 to aid in converting additional coal feed. The degassed mixture then is withdrawn from the degassing zone 22 and introduced into a fractionation zone 32 through a conduit 30. Alternatively, the degassed mixture may be introduced directly into the deashing process to be described hereafter.

The coal liquefaction process hereinbefore described has been cited merely to illustrate one means of coal conversion and it therefore is not intended to limit the scope of the invention to that particular means. The process of the present invention would be equally applicable to any other technique which yields coal liquefaction products.

The fractionation zone 32 may comprise, for example, an atmospheric or vacuum distillation vessel. The selection of a particular distillation vessel depends upon the particular coal conversion scheme utilized. In a conversion process in which little coal is converted to distillate fractions and the process solvent is imbibed or dissolved in the coal liquefaction products, an atmospheric distillation vessel may be preferred to reduce the possibility of thermal repolymerization of the coal conversion products. In a conversion process in which a substantial quantity of the coal is converted to distillate fractions, a vacuum distillation vessel may be preferred to maximize the recovery of volatile products.

In the process of effecting the hydroconversion of the raw coal, some of the hydrogen donor components in the process solvent have been consumed or otherwise lost to the process.

In some conversion schemes, particularly those in which a large portion of the coal is converted to distillate fractions, process solvent is produced as a distillate product of the conversion in excess of the amount of process solvent consumed. Such a process is capable of selfsustainment in regard to its process solvent requirements.

In other coal conversion schemes, such as low residence time, low hydrogen consumption conversions in which the process solvent is imbibed or dissolved in the coal liquefaction products, process solvent is not recovered in sufficient quantity to provide a self-sustaining process. In a conversion scheme, such as the latter, the fractionation zone 32 is operated to substantially separate the remaining hydrogen donor depleated process solvent from the coal liquefaction products. The separated hydrogen donor depleated process solvent stream is withdrawn via a conduit 34 for recycle to conduit 14 and re-introduction into the liquefaction process. Alternatively, some or all of the withdrawn hydrogen donor depleated process solvent can be introduced into a hydrotreating zone (not shown).

In the hydrotreating zone, the hydrogen donor depleated process solvent can be enriched in hydrogen donor components. However, the enriched process solvent is not produced in sufficient quantity to replace that process solvent which has been lost to the process during the hydroconversion of the raw coal. Make-up process solvent (from an external source not shown) may be introduced into the recycled process solvent stream via a conduit 15 to replace a portion of the lost process solvent. However, such addition is not desirable as it results in a less economical process.

The coal liquefaction products are contacted with a deashing solvent entering second mixing zone 38 via a conduit 40 to form a prepared mixture. Sufficient deashing solvent is introduced into the second mixing zone 38 to provide a ratio by weight of coal liquefaction products to deashing solvent in the prepared mixture of from about 1:1 to about 1:10. It is to be understood that larger quantities of deashing solvent may be employed, however, such use is uneconomical. Thereafter, the prepared mixture is discharged through a conduit 42 to enter a first stage settler 44.

The process of the present invention is particularly beneficial which operatively associated with a coal conversion process that is not self-sustaining in regard to process solvent requirements. More particularly, the process of the present invention provides a means of producing a heretofore unavailable hydrogen-rich donor fraction to supplant a portion of the process solvent. The production of such a heretofore unavailable fraction eliminates the necessity of addition of make-up process solvent to the conversion scheme. This results in a much more economical process than heretofore possible.

Figure 2:
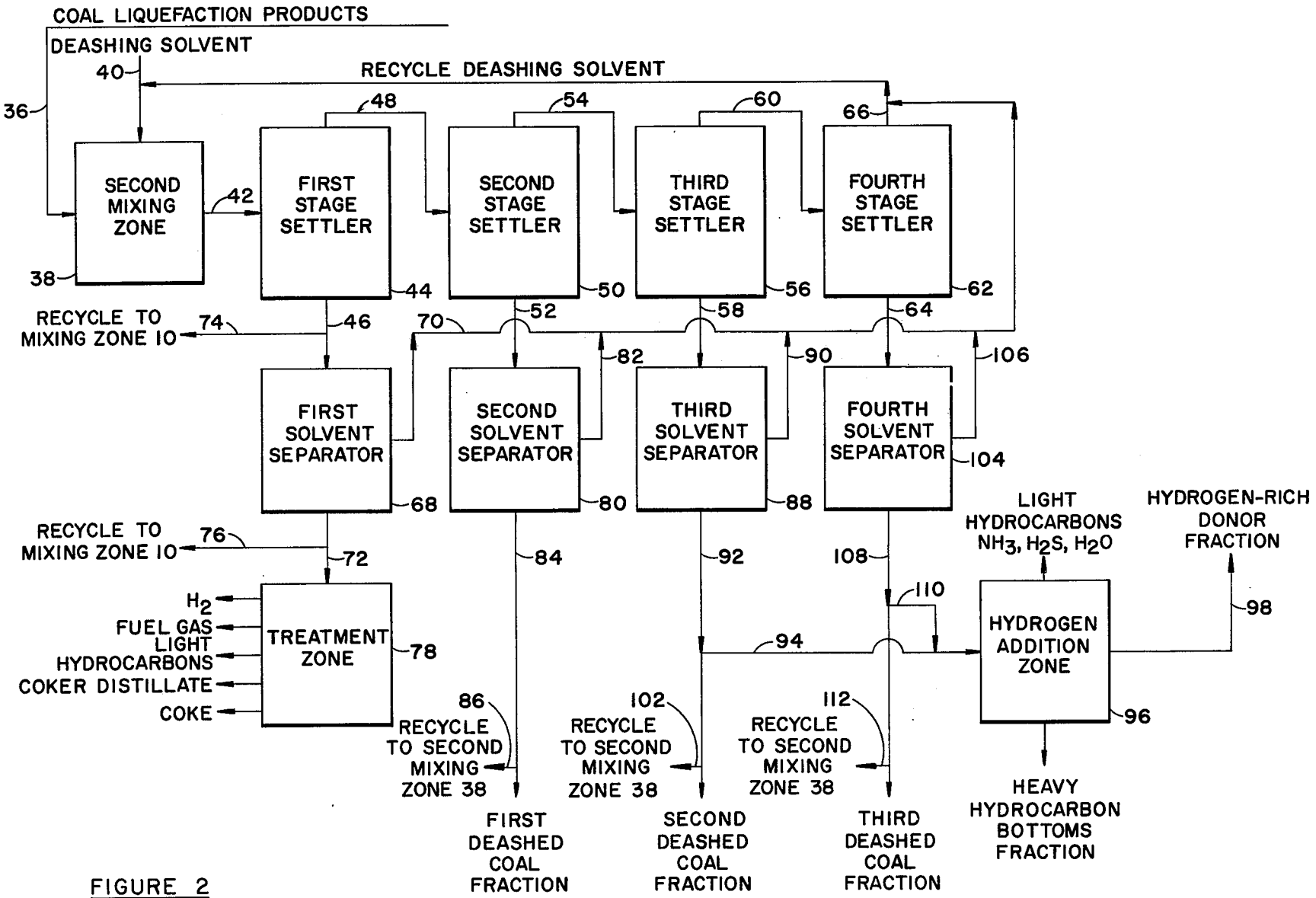
FIG. 2 is a diagrammatic, schematic illustration of a process suitable for the practice of this invention.

Turning now to FIG. 2, the separated coal liquefaction products and some remaining process solvent are withdrawn from fractionation zone 32 through a conduit 36 and introduced into a second mixing zone 38.

The first stage settler 44 is maintained at a temperature level of from about 400 degrees F. to about 700 degrees F. and a pressure level in the range of from about 600 psig to about 1000 psig to effect a separation of the prepared mixture.

In first stage settler 44, the prepared mixture separates into a first light phase comprising deashing solvent and soluble coal products and a first heavy phase comprising insoluble coal products, some soluble coal products and some deashing solvent.

The first heavy fraction is withdrawn from the first stage settler 44 via a conduit 46 and introduced into a first solvent separator 68. In the first solvent separator 68, the first heavy phase is flashed to form at least one stream comprising ash concentrate and one other overhead stream comprising deashing solvent.

The term "ash concentrate" means a composition of matter comprising primarily insoluble coal products and a minor amount of soluble coal products formed upon flashing the first heavy phase.

The deashing solvent stream is withdrawn from the first solvent separator 68 through a conduit 70 for recycle to aid in providing the prepared mixture. The ash concentrate is withdrawn from the first solvent separator 68 through a conduit 72 by any suitable means.

A portion of the withdrawn stream comprising the first heavy phase fraction also can be recycled to the first mixing zone 10 via a conduit 74 for additional liquefaction. Such recycle provides a means by which the conversion of a coal feed may be improved. This is particularly desirable in those instances in which the coal feed has not been subjected to a rigorous conversion and therefore a substantial quantity of potentially recoverable coal values remain in the first heavy fraction. Alternatively, a portion of the ash concentrate in conduit 72 can be recycled to the first mixing zone 10 through a conduit 76 by any suitable means. The ash concentrate also can be introduced into a treatment zone 78 wherein it is subjected to gasification to produce process fuel gas and hydrogen or subjected to low temperature carbonization and then the residual solids can be gasified to yield hydrogen, fuel gas, light hydrocarbons, coker distillate and coke.

The first light phase is withdrawn from the first stage settler 44 through a conduit 48 and introduced into a second stage settler 50. The second stage settler 50 is maintained at a temperature level in the range of from about 450 degrees F. to about 800 degrees F. and a pressure level in the a range of from about 400 psig to about 1000 psig. The heating of the first light phase to the temperature of the second stage settler 50 can be achieved by passage through a heater (not shown) interposed in conduit 48.

The particular temperature and pressure conditions in the second stage settler 50 are selected to provide a differential in the deashing solvent density existing within the first stage settler 44 and the second stage settler 50, sufficiently large to cause the first light phase to separate into a second light phase comprising deashing solvent and light soluble coal products and a second heavy phase comprising heavy soluble coal products and some deashing solvent.

The second heavy phase is withdrawn from the second stage settler 50 via a conduit 52 and introduced into a second solvent separator 80.

In the second solvent separator 80, the second heavy phase is flashed to form a first deashed coal fraction comprising heavy soluble coal products and one other overhead stream comprising deashing solvent. The deashing solvent stream is withdrawn from the second solvent separator 80 through a conduit 82 for eventual recycle to the second mixing zone 38. The first deashed coal fraction is withdrawn from the second solvent separator 80 through a conduit 84. The first deashed coal fraction can be sold as a fuel product, or a portion can be recycled for other use in the processing system, such as for example, to the second mixing zone 38 via a conduit 86.

The second light phase is withdrawn from the second stage settler 50 via a conduit 54 and is introduced into a third stage settler 56.

The particular temperature and pressure conditions in the third stage settler 56 are selected to provide a differential in the deashing solvent density existing within the second stage settler 50 and the third stage settler 56 sufficiently large to cause the second light phase to separate into a third light phase comprising deashing solvent and some light soluble coal products and a third heavy phase comprising heavier soluble coal products.

In one particular embodiment, the temperature level of the third stage settler 56 is maintained higher than the temperature level in the second stage settler 50 and the pressure level is maintained at a level substantially no greater than the pressure level of the first stage settler 44. Further, the pressure level of the third stage settler 56 is maintained at a level substantially no greater than the pressure level of the second stage settler 50. More particularly, the pressure level in the third stage settler 56 is maintained in the range of from about 20 psig to about 1000 psig.

The third heavy phase is withdrawn from the third stage settler 56 through a conduit 58 and introduced into a third solvent separator 88.

In the third solvent separator 88, the third heavy phase is flashed to form a second deashed coal fraction comprising soluble coal products and one other overhead stream comprising deashing solvent. The deashing solvent stream is withdrawn from the third solvent separator 88 through a conduit 90 for eventual recycle to the second mixing zone 38 to aid in providing the prepared mixture. The second deashed coal fraction is withdrawn from the third solvent separator 88 through a conduit 92. A portion of the second deashed coal fraction flowing in conduit 92 may be introduced through a conduit 94 into a hydrogen addition zone 96.

In hydrogen addition zone 96, the second deashed coal fraction is treated to effect an addition of hydrogen thereto to yield a hydrogen-rich donor fraction. The hydrogen-rich donor fraction is withdrawn from the hydrogen addition zone 96 through a conduit 98. At least a portion of the hydrogen-rich donor fraction in conduit 98 is recycled to conduit 14 for reintroduction into the coal liquefaction process to supplant a portion of the process solvent. The use of such a hydrogen-rich donor fraction to supplant a portion of the process solvent results in a more economical conversion of the feed to usable coal liquefaction products in that make-up process solvent is not required. The fractions from which the hydrogen-rich donor fractions are produced are obtained only through the use of deashing solvents maintained at temperatures near the critical temperature of the deashing solvent. Any excess hydrogen-rich donor fraction produced by this process may be introduced into subsequent refining apparatus (not shown) to provide additional high grade products.

In one preferred embodiment, the hydrogen addition zone 96 comprises a catalytic hydrotreater. In the hydrotreater, the second deashed coal fraction is hydrogenated to yield a partially desulfurized and partially denitrogenized hydrogen-rich donor fraction and a partially desulfurized and partially denitrogenized heavy hydrocarbon bottoms fraction. An overhead stream comprising, for example, light hydrocarbons, $NH_3$, $H_2S$ and $H_2O$ also is formed. The overhead stream may be treated to recover the light hydrocarbons therefrom.

The partially desulfurized and partially denitrogenized hydrogen-rich donor fraction is withdrawn and recycled as previously set forth.

The partially desulfurized and partially denitrogenized heavy hydrocarbon bottoms fraction may be withdrawn and sold as a premium grade fuel product or employed as a refinery feed stock. However, by blending a portion of this partially desulfurized material with a deashed coal fraction, an increased yield of a product capable of providing environmentally acceptable levels of sulfur and mineral matter is produced. Additionally, a portion of the partially desulfurized and partially denitrogenized hydrogen-rich donor fraction may be blended with either the heavy hydrocarbon bottoms fraction or the deashed coal fractions to further upgrade the coal products of this process. Thus, a deashed coal fraction which contains an environmentally unacceptable concentration of sulfur or mineral matter with respect to a particular location's clean air standards can be converted to an acceptable product (low sulfur, low mineral matter and high hydrocarbon value) by adding thereto a quantity of the partially desulfurized and partially denitrogenized hydrogen-rich donor fraction or the heavy hydrocarbon bottoms fraction.

The second deashed coal fraction not withdrawn from conduit 92 through conduit 94 can be sold as a fuel product, or a portion can be recycled, for example, to the second mixing zone 38 or other critical solvent deashing process vessel for other use in the processing system via a conduit 102.

The third light phase is withdrawn from the third stage settler 56 through a conduit 60 and introduced into a fourth stage settler 62.

In the event that it is desired to effect only three separations, it is necessary to adjust the temperature and pressure conditions in the third stage settler 56 such that a separation can be effected in the third stage settler 56 to provide a third light phase comprising deashing solvent and a third heavy phase comprising soluble coal products. The deashing solvent is withdrawn from the third stage settler and recycled to the second mixing zone 38 to aid in providing the prepared mixture (not shown).

In the fourth stage settler 62, the particular temperature and pressure conditions are selected to provide a differential in the deashing solvent density existing within the third stage settler 56 and the fourth stage settler 62 sufficiently large to cause the third light phase to separate into a fourth light phase comprising deashing solvent and a fourth heavy phase comprising soluble coal products and some deashing solvent.

In the event that more than four separations are to be effected, it is necessary to adjust the temperature and pressure conditions such that a separation can be effected in the fourth stage settler 62 to provide a fourth light phase comprising deashing solvent and some light soluble coal products and a fourth heavy phase comprising the remaining soluble coal products and some deashing solvent. In this event, the fourth light phase is withdrawn and introduced into a subsequent settler wherein conditions are adjusted to cause the fourth light phase to separate and provide additional soluble coal product fractions such that in a designated final separation in a final settler, a light phase comprising deashing solvent and a heavy phase comprising soluble coal products are produced.

In the event that additional separations are not made, the fourth light phase is withdrawn from the fourth stage settler through a conduit 66 for recycle to the second mixing zone 38.

The fourth heavy phase comprising soluble coal products and some deashing solvent is withdrawn from the fourth stage settler via a conduit 64 and introduced into a fourth solvent separator 104.

In the fourth solvent separator 104, the fourth heavy phase is flashed to form a third deashed coal fraction comprising soluble coal products and one other overhead stream comprising deashing solvent. The deashing solvent stream is withdrawn from the fourth solvent separator 104 through a conduit 106 for eventual recycle to the second mixing zone 38. The third deashed coal fraction is withdrawn from the fourth solvent separator 104 through a conduit 108. A portion of the third deashed coal fraction may be introduced into the hydrogen addition zone 96 through a conduit 110.

In the hydrogen addition zone 96 the third deashed coal fraction is treated to effect an addition of hydrogen thereto to yield a hydrogen-rich donor fraction. The third deashed coal fraction may be introduced singly or in admixture with a portion of the second deashed coal fraction or other deashed coal fraction into the hydrogen addition zone 96. The hydrogen-rich donor fraction is withdrawn through conduit 98 for recycle to supplant a portion of the process solvent as set forth hereinbefore.

The third deashed coal fraction not withdrawn from conduit 108 through conduit 110 can be sold as a fuel product, or a portion can be recycled, for example, to the second mixing zone 38 or other critical solvent deashing process vessel for other use in the processing system via a conduit 112.

In an alternate embodiment, the fourth stage settler 62 comprises a flash vessel. In this embodiment, the third light phase is flashed to form the third deashed coal fraction and one other overhead stream comprising deashing solvent. This eliminates the fourth solvent separator 104 from the process.

For the purpose of illustrating the present invention and not by way of limitation coal liquefaction products are prepared by mixing particulate coal containing 9.4 percent ash with a process solvent containing 9.1 percent hydrogen in a ratio of about one part by weight of dry coal to about 2.5 parts by weight of process solvent and solubilizing the mixture at a pressure level in the range of from about 1200 psig to about 1500 psig and at a temperature level in the range of from about 800 degrees F. to about 825 degrees F. for about 0.25 hours in the presence of hydrogen. The coal liquefaction products so prepared were analyzed and found to have the analyses set forth in Table I, below.

TABLE I

| | |
|---|---|
| Specific gravity | |
| 60/60 | 1.34 |
| Proximate analysis | |
| % Loss at 105° C. | 0.4 |
| % Volatile Matter | 44.7 |
| % Fixed Carbon | 41.5 |
| % Ash | 13.4 |
| Ultimate analyses | |
| % Carbon | 74.3 |
| % Hydrogen | 5.3 |
| % Nitrogen | 1.5 |
| % Sulfur | 2.0 |
| % Oxygen (diff.) | 3.5 |
| Sulfur Distribution | |
| $SO_4$ | <0.1 |
| Pyrite | <0.1 |
| Pyrrhotite | 1.81 |
| Organic | 0.19 |

The coal liquefaction products are mixed with a deashing solvent comprising benzene in a ratio of about one part by weight of coal liquefaction products to about 3.5 parts by weight of benzene at a pressure level in the range of from about 600 psig to about 1000 psig and a temperature level in the range of from about 400 degrees F. to about 620 degrees F. to form a prepared mixture.

The prepared mixture is introduced into the first stage settler 44. First stage settler 44 is maintained at a temperature level of about 525 degrees F. and a pressure level of about 820 psig to effect a separation of the prepared mixture into a first light phase and a first heavy phase. The first light phase is withdrawn from the first stage settler 44 and introduced into the second stage settler 50.

The second stage settler 50 is maintained at a temperature level of about 650 degrees F. and a pressure level of about 815 psig to effect a separation of the first light phase into a second light phase and a second heavy phase. The second light phase is withdrawn from the second stage settler 50 and introduced into the third stage settler 56.

The third stage settler is maintained at a temperature level of about 750 degrees F., and a pressure level of about 810 psig to effect a separation of the second light phase into a third light phase and a third heavy phase. The third heavy phase is withdrawn from the third stage settler 56, treated to recover deashing solvent and introduced into the hydrogen addition zone 96.

The second deashed coal fraction is treated in hydrogen addition zone 96 to produce a hydrogen-rich donor fraction containing approximately 9.1 percent hydrogen. The hydrogen-rich donor fraction is withdrawn from the hydrogen addition zone 96 and recycled to supplant a portion of the process solvent in the liquefaction process.

In subsequent solubilizations, employing at least a portion of the coal derived hydrogen-rich donor material of the present invention as process solvent, the previously described particulate coal introduced as feed to the liquefaction process is converted to coal liquefaction products comparable to those produced with the non-coal derived process solvent.

To further illustrate the present invention coal liquefaction products are prepared by mixing particulate coal containing 9.4 percent ash with process solvent as previously described and solubilizing the mixture at a pressure level in the range of from about 1000 psig to about 1200 psig and at a temperature level in the range of from about 750 degrees F. to about 775 degrees F. for about 0.085 hours in the presence of hydrogen such that hydrogen consumption is only about one percent by weight of coal. The process solvent is recovered from the coal liquefaction products for recycle and is found to be insufficient in quantity to provide a self-sustaining cyclic liquefaction process.

The coal liquefaction products are mixed with benzene as previously described to form a prepared mixture. The prepared mixture is introduced into the first stage settler 44. First stage settler 44 is maintained at a temperature level of about 525 degrees F. and a pressure level of about 820 psig to effect a separation of the prepared mixture into a first light phase and a first heavy phase. The first light phase is withdrawn from the first stage settler 44 and introduced into the second stage settler 50.

Second stage settler 50 is maintained at a temperature level of about 630 degrees F. and a pressure level of about 815 psig to effect a separation of the first light phase into a second light phase and a second heavy phase. The second light phase is withdrawn from the second stage settler 50 and introduced into a third stage settler 56.

Third stage settler 56 is maintained at a temperature level of about 680 degrees F. and a pressure level of about 815 psig to effect a separation of the second light phase into a third light phase and a third heavy phase. The third light phase is withdrawn from the third stage settler 56 and introduced into a fourth stage settler 62.

Fourth stage settler 62 comprises a flash vessel. The third light phase is flashed to form a third deashed coal fraction and an overhead stream comprising benzene. The third deashed coal fraction is withdrawn from the fourth stage settler 62 and introduced into the hydrogen addition zone 96.

In hydrogen addition zone 96, the third deashed coal fraction is treated to produce a hydrogen-rich donor fraction containing approximately 9.1 percent hydrogen. The hydrogen-rich donor fraction is withdrawn from the hydrogen addition zone 96 and introduced into the liquefaction process in a quantity sufficient to supplant that process solvent which has been lost or otherwise consumed.

In subsequent solubilizations employing at least a portion of the coal derived hydrogen-rich donor material of the present invention as process solvent, the previously described particulate coal introduced as feed to the liquefaction process is converted to coal liquefaction products comparable to those produced with the non-coal derived process solvent.

The term "deashing solvent" as used herein refers to those solvents consisting essentially of at least one substance having a critical temperature below about 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

The term "process solvent" as used herein refers to those solvents described as "liquefying solvents" in U.S. Pat. Nos. 3,607,716, 3,607,717 and 3,607,718 the disclosures of which are incorporated herein by reference.

The term "insoluble coal product" as used herein refers to the undissolved coal, mineral matter, other solid inorganic particulate matter and other such matter which is insoluble in the process solvent and deashing solvent under the conditions of the process of this invention. The term "soluble coal product" as used herein refers to the constituent fractions in the coal which are soluble in the liquefaction process solvent and deashing solvent. The term "light soluble coal product" as used herein refers to those fractions of the soluble coal product having a density less than the average density of the soluble coal product introduced as feed into a designated separation zone. The term "heavy soluble coal product" as used herein refers to those fractions of the soluble coal product having a density greater than the average density of the soluble coal product introduced as feed into a designated separation zone.

While the subject invention has been described employing only four separations, it is to be understood that a multiplicity of coal liquefaction product separations can be achieved in a multiplicity of settlers by the process hereinbefore described prior to production of the coal derived, hydrogen-rich donor fractions for recycle to supplant a portion of the process solvent.

Therefore, while this invention has been described with respect to what at present is considered to be the preferred embodiment thereof, it is to be understood that changes or modifications can be made in the process disclosed without departing from the spirit or scope of the invention as defined by the following claims.

What is claimed is:

1. A process comprising:

mixing in a first mixing zone a process solvent with a coal feed;

introducing said coal feed and said process solvent into a liquefaction zone maintained at elevated temperature and pressure to effect at least a partial conversion of the coal into coal liquefaction products;

introducing said coal liquefaction products into a fractionation zone to produce a coal liquefaction products residuum comprising substantially non-distillable soluble coal products and insoluble coal products;

introducing the coal liquefaction products residuum into a second mixing zone;

providing a deashing solvent, said deashing solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing said deashing solvent into said second mixing zone;

mixing said coal liquefaction products residuum with said deashing solvent to provide a prepared mixture;

withdrawing said prepared mixture;

introducing said prepared mixture into a first stage settler;

maintaining said first stage settler at a temperature level in the range of from about 400 degrees F. to about 700 degrees F. and a pressure level of from about 600 psig to about 1000 psig to effect a separation of said prepared mixture in said first stage settler into a first heavy phase comprising insoluble coal products, some soluble coal products and some deashing solvent and a first light phase fraction comprising soluble coal products and deashing solvent;

withdrawing said first heavy phase from the first stage settler;

withdrawing said first light phase from said first stage settler;

introducing said withdrawn first light phase into a second stage settler;

maintaining said second stage settler at a temperature level in the range of from about 450 degrees F. to about 800 degrees F. and a pressure level in the range of from about 400 psig to about 1000 psig to effect a separation of said first light phase in said second stage settler into a second heavy phase comprising heavy soluble coal products and some deashing solvent and a second light phase comprising light soluble coal products and deashing solvent;

withdrawing said second heavy phase from said second stage settler;

withdrawing said second light phase from the second stage settler;

introducing the withdrawn second light phase into at least a third stage settler;

maintaining said third stage settler at an elevated temperature level and pressure level selected to provide a differential in the deashing solvent density existing within the second stage settler and the third stage settler sufficiently large to cause the second light phase to separate into a third heavy phase comprising light soluble coal products and some deashing solvent a third light phase comprising deashing solvent;

withdrawing said third heavy phase from said third stage settler;

withdrawing said third light phase from said third stage settler for recycle to second mixing zone to aid in providing said prepared mixture;

introducing at least a portion of said third heavy phase into a hydrogen addition zone;

treating said third heavy phase in said hydrogen addition zone to form a hydrogen-rich donor fraction;

withdrawing said hydrogen-rich donor fraction from said hydrogen addition zone; and recirculating at least a portion of said withdrawn hydrogen-rich donor fraction to supplant at least a portion of said process solvent employed in preparing the coal liquefaction products.

2. The process of claim 1 wherein the hydrogen addition zone is defined further as a catalytic hydrotreater and the process is defined further as:

introducing at least a portion of said third heavy phase into a catalytic hydrotreater;

hydrotreating said third heavy phase in said catalytic hydrotreater to form a partially desulfurized and partially denitrogenized hydrogen-rich donor fraction and a partially desulfurized and partially denitrogenized heavy hydrocarbon bottoms fraction;

withdrawing the partially desulfurized and partially denitrogenized hydrogen-rich donor fraction from the catalytic hydrotreater; and recirculating at least a portion of the partially desulfurized and partially denitrogenized hydrogen-rich donor fraction to supplant at least a portion of the process solvent employed in preparing the coal liquefaction products.

3. The process of claim 1 wherein the third light phase is defined further as comprising deashing solvent and soluble coal products and the process is defined further as:

withdrawing the third light phase comprising soluble coal products and deashing solvent from the third stage settler;

introducing the third light phase into a fourth stage settler;

maintaining the fourth stage settler at an elevated temperature level and pressure level selected to provide a differential in the deashing solvent density existing within the third stage settler and the fourth stage settler sufficiently large to cause the third light phase to separate into a fourth heavy phase comprising soluble coal products and some deashing solvent and a fourth light phase comprising deashing solvent;

withdrawing the fourth light phase from the fourth stage settler for recycle to the second mixing zone;

withdrawing the fourth heavy phase from the fourth stage settler;

introducing at least a portion of the fourth heavy phase into the hydrogen addition zone; and treating said fourth heavy phase in said hydrogen addition zone to form a hydrogen-rich donor fraction.

4. The process of claim 2 defined further to include the steps of:

withdrawing the partially desulfurized and partially denitrogenized heavy hydrocarbon bottoms fraction; and blending a portion of the withdrawn heavy hydrocarbon bottoms fraction with at least a portion of the withdrawn second heavy phase to form a product fraction having a lower sulfur and mineral matter content.

5. A process as set forth in claim 4 in which at least a portion of the blend of withdrawn second heavy phase and heavy hydrocarbon bottoms fraction is withdrawn and blended with at least a portion of the partially desulfurized and partially denitrogenized hydrogen-rich donor fraction to form a product fraction having a lower sulfur and mineral matter content and a higher hydrocarbon value.

6. The process of claim 5 wherein the hydrogen addition zone is defined further as a catalytic hydrotreater and the process is defined further as:

introducing at least a portion of said fourth heavy phase into a catalytic hydrotreater;

hydrotreating said fourth heavy phase in said catalytic hydrotreater to form a partially desulfurized and partially denitrogenized hydrogen-rich donor fraction and a partially desulfurized and partially denitrogenized heavy hydrocarbon bottoms fraction;

withdrawing the partially desulfurized and partially denitrogenized hydrogen-rich donor fraction from the catalytic hydrotreater; and recirculating at least a portion of the partially desulfurized and partially denitrogenized hydrogen-rich donor fraction to supplant at least a portion of the process solvent employed in preparing the coal liquefaction products.

7. The process of claim 3 wherein the third heavy phase is withdrawn and recovered without introduction into the hydrogen addition zone.

8. The process of claim 6 defined further to include the steps of:

withdrawing the partially desulfurized and partially denitrogenized heavy hydrocarbon bottoms fraction; and blending a portion of the withdrawn heavy hydrocarbon bottoms fraction with at least a portion of the withdrawn second heavy phase to form a product fraction having a lower sulfur and mineral matter content.

9. A process as set forth in claim 8 in which at least a portion of the blend of withdrawn second heavy phase and heavy hydrocarbon bottoms fraction is withdrawn and blended with at least a portion of the partially desulfurized and partially denitrogenized hydrogen-rich donor fraction to form a product fraction having a lower sulfur and mineral matter content and a higher hydrocarbon value.

10. The process of claim 7 wherein the hydrogen addition zone is defined further as a catalytic hydrotreater and the process is defined further as:

introducing at least a portion of said fourth heavy phase into a catalytic hydrotreater;

hydrotreating said fourth heavy phase in said hydrotreater to form a partially desulfurized and partially denitrogenized hydrogen-rich donor fraction and a partially desulfurized and partially denitrogenized heavy hydrocarbon bottoms fraction;

withdrawing the partially desulfurized and partially denitrogenized hydrogen-rich donor fraction from the catalytic hydrotreater; and recirculating at least a portion of the partially desulfurized and partially denitrogenized hydrogen-rich donor fraction to supplant at least a portion of the process solvent employed in preparing the coal liquefaction products.

* * * * *